US005364200A

United States Patent [19]

Russo et al.

[11] Patent Number: 5,364,200

[45] Date of Patent: Nov. 15, 1994

[54] REINFORCEMENT TAPE FOR LOOSE LEAF SHEET

[75] Inventors: Kenneth J. Russo, Villa Park; George Block, Park Ridge, both of Ill.

[73] Assignee: Carsten Health Industries, Inc., Chicago, Ill.

[21] Appl. No.: 997,212

[22] Filed: Dec. 28, 1992

[51] Int. Cl.[5] ..... B42F 13/00

[52] U.S. Cl. ..... 402/79; 283/105

[58] Field of Search ..... 283/79, 105; 402/79

[56] References Cited

U.S. PATENT DOCUMENTS

| | | | |
|---|---|---|---|
| 2,346,219 | 4/1944 | Johnson | 283/105 |
| 2,574,152 | 11/1951 | Lewis et al. | 206/56 |
| 2,764,501 | 9/1956 | Perri | 117/25 |
| 3,799,417 | 3/1974 | Williams | 225/7 |
| 4,072,554 | 2/1978 | McKibben | 156/514 |
| 4,173,676 | 11/1979 | Asakura et al. | 428/332 |
| 4,525,399 | 6/1985 | Fields | 428/43 |
| 4,662,770 | 5/1987 | Block | 402/80 R |

*Primary Examiner*—Paul A. Bell

*Attorney, Agent, or Firm*—Leydig, Voit & Mayer, Ltd.

[57] ABSTRACT

An inexpensive, easy to use backing-free reinforcement tape and method of making the same, for loose leaf sheets such as medical records and the like comprising a strong, thin plastic strip for adhesively mounting over the holes of a loose leaf sheet, one side of the plastic strip having a pressure sensitive adhesive applied thereto and the other side having an adhesive-repellant coating applied thereto, which allows the adhesive side of the reinforcement strip to release cleanly from the adhesive-repellant coating as the reinforcement strip is dispensed off a roll.

13 Claims, 3 Drawing Sheets

REINFORCEMENT TAPE FOR LOOSE LEAF SHEET

FIELD OF THE INVENTION

This invention relates in general to reinforcement for loose leaf sheets and particularly to backing-free pressure sensitive adhesive reinforcement tape for removable record sheets and the like.

BACKGROUND

In many environments, notably hospitals and other institutions, there is a great demand for removable record sheets. The record sheets and charts are generally preprinted and may include one or more mounting hole configurations to enable their use in a wide variety of binder arrangements such as top and side mounting binders. Typical loose leaf binder mounting arrangements include three and five holes. There are also two hole arrangements for use with traditional flat metal fasteners and European format binders.

Institutional records are subject to a lot of wear and tear, thus often requiring reinforcement. Currently, there are several devices available for reinforcing the mounting holes of removable record sheets. One commonly used reinforcement device consists of ring-shaped pieces of fabric or plastic, coated with adhesive on the mounting side, that are individually positioned around each mounting hole to strengthen the surrounding paper material. These rings are difficult to align around the mounting hole and readily fall off the paper surrounding the mounting hole. There are also specially manufactured reinforced loose leaf sheets having plastic material or metal joined along the mounting edge of the sheet and incorporating mounting holes therein. These special devices are very expensive, and consequently not widely used.

In addition, pressure sensitive reinforcement tape has been used for reinforcing loose leaf sheets. U.S. Pat. No. 4,662,770 to Block discloses a mounting hole reinforcement device having pre-punched mounting holes along a supporting edge. This reinforcement tape is dispensed on a backing paper strip which includes a non-stick surface to which the adhesive side of the individual pre-cut reinforcement tapes are removably adhered. The backing paper is necessary to prevent the adhesive side of the reinforcement tape from adhering to the non-adhesive side of the tape. The tapes and the backing paper are coiled into a roll and placed within a dispensing box through which one end of the roll emerges. If the reinforcement tape of the '770 patent is rolled without the backing paper, it cannot be dispensed without leaving a sticky residue on the non-adhesive side of the tape. In addition, removal of the backing paper from the reinforcement tape is difficult and time consuming. Also, the use of reinforcement tape having backing paper requires special dispensers. Further, a roll of reinforcement tape with backing paper is bulkier; consequently it is more difficult to package, store and use.

Accordingly, it is an object of the present invention to provide an economical reinforcement device for loose leaf sheets which does not have a backing strip, is easy to apply, and remains affixed to the loose leaf sheets.

An additional object of the present invention is to provide a reinforcement device for loose leaf records which may be readily dispensed by conventional tape dispensing means.

A further object of the invention is to provide a backing-free reinforcement device for loose leaf records that will support the weight of the loose leaf binder without tearing the reinforcement device.

SUMMARY OF THE INVENTION

The present invention overcomes the deficiencies in prior loose leaf reinforcement devices by providing a reinforcement strip comprising a thin plastic strip having sufficient strength to support the approximate weight of a loose leaf binder, one side of the plastic strip having a pressure sensitive adhesive layer applied thereto and the other side of the plastic strip having an adhesive-repellant coating applied thereto.

The present invention also provides a method for making the reinforcement strip of the present invention comprising, in its preferred form, (a) applying a layer of pressure sensitive adhesive on a release liner; (b) curing the adhesive layer by heating; (c) cooling the adhesive layer; (d) laminating the release liner and a thin plastic strip together such that the adhesive layer is transferred to the plastic strip; (e) applying a adhesive-repellant coating to the other side of the plastic strip; (f) punching holes in or scoring or perforating the strip in a particular desired configuration; and (g) delaminating the release liner from the plastic strip.

Figure 1:
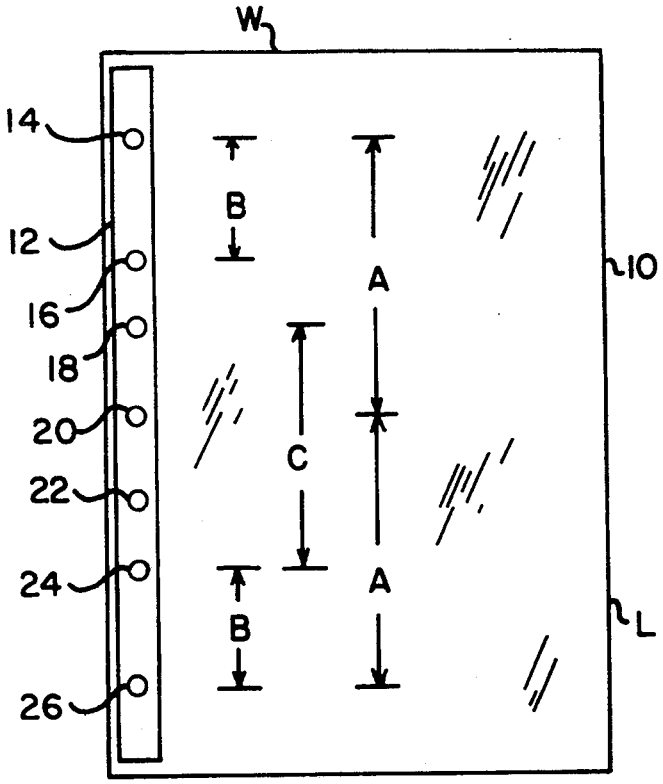
Referring to FIG. 1, a loose leaf sheet 10 having a width W and a length L is shown with a reinforcement strip 12 vertically affixed along the left side thereof. Strip 12 includes a plurality of centrally disposed non-uniformly spaced holes therealong, each of a diameter equal to or slightly greater than the corresponding diameter of the pre-punched mounting holes along the edge of sheet 10. For the purpose of description, sheet 10 is assumed to have three mounting holes along its left hand edge corresponding to holes 14, 20 and 26 in strip 12. As indicated by the dimension lines, the distance between hole 14 and hole 20 is "A" as is the distance between hole 20 and hole 26. The distance "A" is selected to correspond to the standard three-hole mounting arrangement for ring binders, namely 4.25 inches for a standard 8½ inches×11 inches sheet or it may be appropriately selected for any other sheet format.

Holes 14, 20 and 26 are indicated by heavy lines to illustrate that they overlie corresponding mounting holes in sheet 10. Strip 12 also includes additional holes 16, 18, 22 and 24 spaced apartly distances selected to conform to different standard mounting hole and ring binder configurations. Thus the distance "B" between holes 14 and 16 and between holes 24 and 26 equal to 2.0 inches. The configuration of holes 14, 16, 20, 24, and 26 corresponds to the hole spacing in a standard five-hole ring binder. Similarly, the distance between holes 18 and 24, indicated by "C" is 2.75 inches and corresponds to a standard two-hole metal clamp spacing. It will be appreciated that for the three-hole mounting arrangement for sheet 10 illustrated, holes 16, 18, 22 and 24 in strip 12 do not correspond to any holes in sheet 10.

Figure 2:
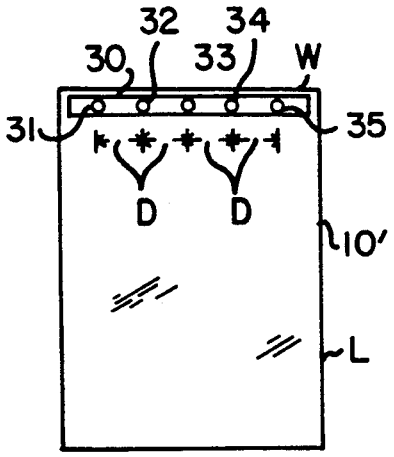

In FIG. 2 a top mounting arrangement for a sheet 10 of width W and length L is illustrated. A reinforcement strip 30 is positioned along the top (W) of sheet 10 and has five equally spaced holes 31, 32, 33, 34 and 35 spaced a distance "D" of 1.375 inches and corresponds to the standard spacing for the two-hole flat metal clamp mentioned previously as well as three and five-hole top edge binder configurations for a standard 8½ inches×11 inches sheet.

Figure 3:
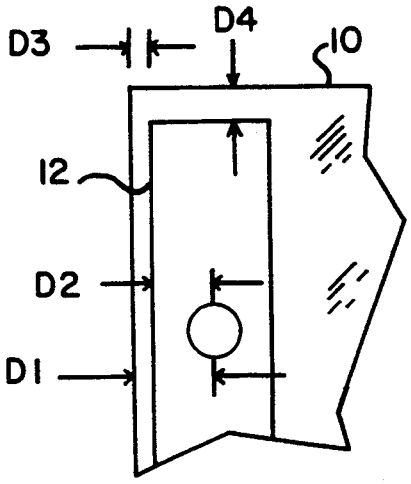

As best illustrated in FIG. 3, each of the strips has a length that is slightly less than the length of the supporting edge of the corresponding loose leaf sheet and a width that is equal to or less than twice the hole center-to-paper edge distance. The reinforcement strip, therefore, does not overlap the sheet in any way. The strip 12, which is preferably fabricated of a thin, strong plastic material such as Mylar ®, for example, is coated on one side with a pressure sensitive adhesive. Dimensioning the strip as described thus precludes the adhesive surface of the strip from being exposed when the reinforcement strip is positioned in overlying relationship with the mounting holes in the paper. In other words, the strip is configured such that it never extends beyond the confines of the sheet to expose the adhesive surface to other sheets or objects. As illustrated, D1 is the pre-punched mounting hole center-to-paper edge distance, D2 is the hole center-to-edge distance of the strip, D3 is the difference between D1 and D2, and D4 is the distance between the end of the strip and the closest adjacent edge of the sheet. Distances D3 and D4 provide margins for precluding the adhesive side of the strip from being exposed to other sheets or objects.

Figure 4:
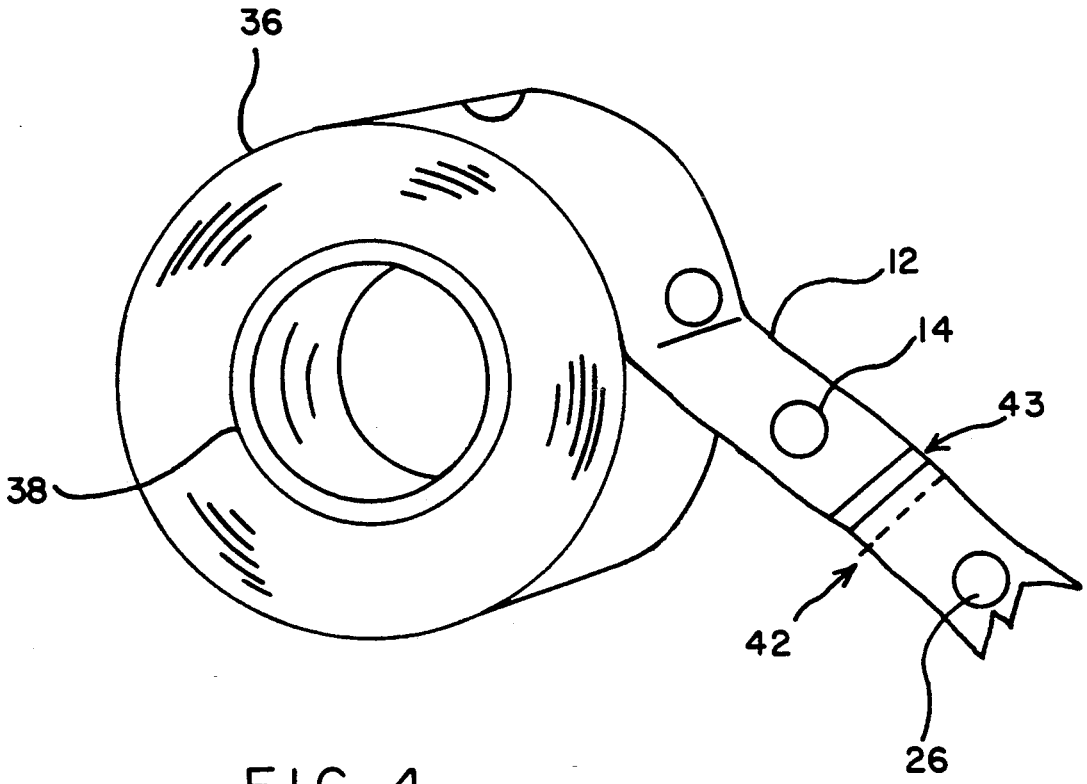

The reinforcement strip may be packaged in a number of ways, preferably in the form of a roll containing a continuous strip or a plurality of pre-separated or scored reinforcement strips as illustrated in FIG. 4. In FIG. 4, a dispenser roll 36 includes a cardboard or plastic core 38, around which a plurality of reinforcement strips 14, approximately ½ inch in width, are arranged such that the adhesive side of the reinforcement strip is removably placed in contact with the top side of the underlying strip, which side has been treated with an adhesive-repellant coating. The strips thus form a continuous spiral, separated by perforations or scoring 42 so that they may be separated to enable a single reinforcement strip to be removed from the roll 36. Markings 43 identify to the user where the beginning of the reinforcement strip 14 is located. Different reinforcement strip configurations are required for top and side mounting hole reinforcement and for different paper sizes. While the packaging configuration illustrated is presently preferred, other packaging arrangements will readily suggest themselves to those of ordinary skill in the art.

DETAILED DESCRIPTION OF THE INVENTION

In general, the reinforcement strip of the present invention comprises a thin (about ½ inch thick) plastic strip having a tensile strength such that the plastic strip will preferably support the approximate weight of a 2 or 2½ inch filled loose leaf binder without tearing, a pressure sensitive adhesive layer applied to one side of the plastic strip and the other side of the plastic strip having an adhesive-repellant coating applied thereto.

Figure 5:
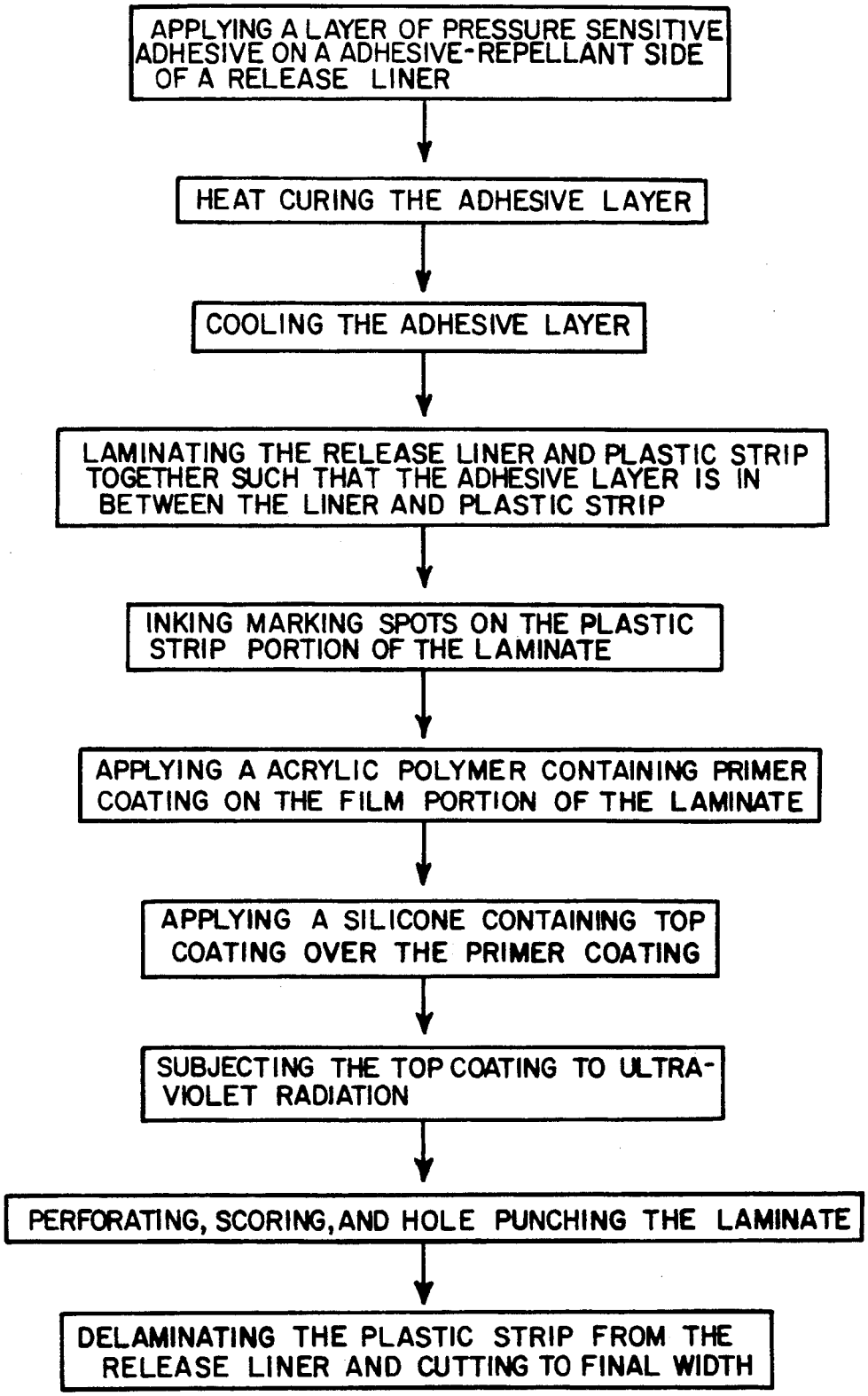

The preferred process for producing a reinforcement device of the present invention is illustrated in FIG. 5. In general, it comprises the steps of (a) applying a layer of pressure sensitive adhesive on a release liner; (b) curing the adhesive layer by heating; (c) cooling the adhesive layer; (d) laminating the release liner and a thin plastic strip together such that the adhesive layer is transferred to one side of the plastic strip; (e) applying markings to the strip; (f) applying an adhesive-repellant coating to the other side of the plastic strip; (g) punching holes and perforations or scoring in the desired configuration; (h) delaminating the release liner from the plastic strip; and (i) spooling the strip onto a roll.

The release liner used to produce the reinforcement strip of the present invention is typically any material having at least one non-stick surface. Preferably the non-stick surface consists of a silicone-treated material. Most preferably, the release liner is a super calendared bleached kraft paper, 40.5 lbs weight, having a silicone coating, manufactured by the Rhinelander Paper Company of Rhinelander, Wis. under the tradename Siltech. The initial preferred width is 27 inches and the preferred thickness is 0.0025 inches. This material is preferred because of its relatively low cost and the ability to achieve a good laydown of adhesive on its silicone coated surface.

The reinforcement strip may be made of any thin plastic film that will preferably support the approximate weight of a filled 2 to 2½ inches loose leaf binder without tearing. It may be transparent or opaque and may be selected from any number of colors to assist in the immediate identification of documents, or to designate particular sizes or hole configurations of the strips. Suitable materials generally include polyethylene, polyester, acetates and polystyrene having tensile strengths from about 40 to about 100 psi, preferably around 70 psi. The plastic strip has a thickness of from about 0.015 to about 0.003 inches, preferably 0.002 inches. The preferred plastic strip material is a 0.002 inch thick polyester film, initially about 27 inches wide, available under the tradename Mylar ®. A much lighter gauge materials, while it may be functional to some degree, may lack the requisite tensile strength and may readily tear, making it less than ideal for most reinforcement applications. A much heavier gauge material on the other hand, while it may be functional, is more bulky and difficult to work with, thus adding to the production cost of the reinforcement strip and impacting its ease of application.

The preferred pressure sensitive adhesive for the reinforcement device comprises latex rubber polymers and tactifying resins. The most preferred pressure sensitive adhesive is TS523, available from Technicote. The adhesive is applied to the non-stick coated side of the release liner, preferably by a roller means in order to achieve a consistent laydown of the adhesive on the liner. The adhesive is applied in an amount sufficient to allow the reinforcement strip to which the adhesive is subsequently transferred to remain firmly affixed to a loose leaf sheet, preferably from about 15 to about 25 lbs of adhesive per roll of liner (27 inches wide, 23,000 lineal ft. long), and most preferably about 20 lbs of adhesive per such roll of liner. The adhesive is heat cured on the liner, preferably in a heated oven at 180°-200° C. for about 15 seconds and then cooled to about room temperature. In order to transfer the adhesive to the reinforcement strip, the release liner is laminated to the reinforcement strip by roller means such that the adhesive layer is between the liner and the strip.

The 27 inches wide laminate is then cut into strips approximately 4½ inches wide by conventional means. At this point, markings may optionally be placed on the side of the 4½ inches wide plastic strips which is not in contact with the adhesive to indicate to the user the beginning and the end of each reinforcement strip, for example. Preferably, the markings are made using a water-based flexographic ink such as Awr-2 series from Arcar Ink of 450 Wegner Drive, West Chicago, Ill. and processed by a flexographic printing press.

Next, the side of the plastic strip not in contact with the adhesive is coated with an adhesive-repellant material. Preferably, the adhesive-repellant coating comprises a primer coat which is applied to the nonadhesive-containing side of the reinforcing strip. The primer coat typically contains a acrylic polymer and a carrier. Preferably, the acrylic polymer also contains styrene. Most preferably, the primer resin is Joncryl 80 manufactured by S.C. Johnson Wax. The acrylic polymer is typically present in the primer composition from about 42% to about 48%, preferably about 45.2% by wt. of the primer coat.

The carrier component of the primer coat assists in the ease and consistency of application of the acrylic polymer to the plastic strip. It comprises a mixture of alcohol and water to control the rate of evaporation of the carrier from the resin material. Typical carriers include alcohols such as ethyl and isopropyl alcohol, water, and mixtures thereof. The carrier is typically present from about 52% to about 58%, preferably about 54.8% by wt. of the primer coat.

The carrier preferably comprises from about 18% to about 22%, most preferably about 20% by wt. of ethyl alcohol, and from about 3% to about 7%, preferably about 5% by wt., of isopropyl alcohol, the balance being water. The primer is applied, preferably by roller means, to the plastic strip. After its application, the carrier is removed preferably by evaporation, leaving primarily the acrylic polymer on the plastic strip.

The top coat acts as an adhesive-repellant and prevents the adhesive side of the reinforcement strip from firmly adhering to the top (non-adhesive containing) side of the reinforcement strip as it is dispensed off a roll. The top coat may be a silicone based material, polytetrafluoroethylene, polyethylene and the like. Preferably, the top coat is a silicone based material. Most preferably, the top coat is a mixture of from about 60% to about 80%, preferably about 70% by wt. of liquid silicone and of from about 20% to about 40%, preferably about 30% by wt. of an ultraviolet varnish. Preferably, the ultra violet varnish is a mixture of acrylated urethons, epoxies and polyesters. It is available under the designation Compound #9405 HG from Northwest Coating Inc. of 6870 S. 13th Street, Oak Creek, Wis. The entire preferred top coat compound (the mixture of silicone and varnish) is available from the same company under the designation Compound #10548. The top coat is preferably applied to the plastic strip by roller. It is then dried or cured, preferably by free radical reactions under high intensity UV light for about 0.24 to about 0.8 seconds, preferably 0.4 seconds.

After the adhesive-repellant layer is applied to the plastic strip, the laminate, still about 4½ inches in width, may be perforated, scored and/or hole punched by conventional means. Perforations are preferably made with an engraved rotary tool. Hole punching is preferably accomplished using die cutting means at the appropriate lengths for side or top mounting binders or fasteners, and the die cut waste circles are preferably removed from the laminate with an air eject rotary die and the vacuum removal method.

Next, the strip is cut to the final width of about ½ inches and the release liner is delaminated from the plastic strip by conventional cutting and delamination methods. The liner and the reinforcement strips are typically rewound onto wind-up rollers.

The embodiments of the reinforcement strip described herein can be conveniently supplied in rolls wound upon a 1 inch or other appropriately sized core of, e.g., plastic or cardboard such that the adhesive side is removably placed in contact with the adjacent, adhesive-repellant side of the strip in a continuous spiral allowing the reinforcement strips to fit into a conventional tape dispenser having a cutting edge. The reinforcement strip can also be dispensed without the aid of a dispenser by manually tearing the reinforcement strip off the roll at the perforations or by simply cutting it.

The following procedure illustrates the preferred method of producing the reinforcement device of the present invention:

A layer of TS523 adhesive was applied to a 27 inch wide, 0.0025 inches thick super calendared bleach kraft paper (40.5# grade) from Rhinelander Paper Company. The adhesive layer was then heat cured by placing the coated liner into a oven at 180°–200° C. for 0.5 seconds. Next, the adhesive layer was allowed to cool to approximately room temperature. Then the release liner and a 0.002 inch thick strip of Mylar® polyester film were laminated together using rollers, such that the adhesive layer was sandwiched in between the liner and the plastic strip and thereby transferred the TS523 adhesive from the release liner to the plastic strip. The laminate was then trimmed into 4½ inch wide intermediate strips. After trimming, lines were marked on the strip using a water-based flexographic ink by a flexographic printing press to indicate to the user where to tear the plastic strip. Next, the primer coat comprising 45.2% by wt. of Joncryl 80, 20% by wt. of ethyl alcohol, 5% by wt. of isopropyl alcohol and 29.8% by wt. water, was applied by a rubber roller to the nonadhesive-containing side of the polyester strip. Then the top coat of Compound 10548 from Northwest Coatings (30% by wt. of liquid silicone and 70% by wt. of UV varnish) was applied over the primer coat with a rubber roller, and dried in a UV oven at about 3000–3500 watts for 0.4 seconds. Perforations were then made in the laminate with an engraved rotary tool, and the strip was hole punched by a die cutting means to the appropriate dimensions. The die cut waste circles were removed from the laminate with an air eject rotary die and the vacuum removal method. The liner was then delaminated and the intermediate strip cut to its final approximate ½ inch width by separately spooling the plastic strip and the liner. The liner was wound onto a waste wind up roller, the plastic strip was wound onto a one inch cardboard core such that the adhesive side was removably placed in contact with the adjacent, adhesive-repellant side of the strip in a continuous spiral containing about 100 reinforcement strips.

Many variations of the invention suggest themselves to those skilled in the art in view of the foregoing disclosure without departing from the spirit and the scope of this invention.

What is claimed is:

1. A reinforcement strip for a loose leaf sheet comprising a thin plastic strip having preselected holes punched therein, a first side of said plastic strip having a pressure sensitive adhesive applied thereto, the second side of said plastic strip having an adhesive-repellant coating applied thereto, said adhesive-repellant coating comprising an acrylic polymer primer coat and a silicone-containing top coat.

2. The reinforcement strip as claimed in claim 1 wherein the plastic strip has a tensile strength of from about 40 to about 100 psi.

3. The reinforcement strip as claimed in claim 1 wherein the plastic strip is Mylar.

4. The reinforcement strip as claimed in claim 1 wherein the primer coat comprises from about 42% to about 48% by wt. of acrylic polymer, from about 18% to about 22% by wt. of ethyl alcohol; from about 3% to about 7% by wt. of isopropyl alcohol; and from about 23% to about 33% by wt. of water.

5. The reinforcement strip as claimed in claim 1 wherein the primer coat comprises about 45.2% by wt. of acrylic polymer; about 20% by wt. of ethyl alcohol; about 5% by wt. of isopropyl alcohol; and about 29.8% by wt. of water.

6. A process for making a reinforcement strip for a loose leaf sheet which strip has an adhesive on one side thereof, which includes the steps of (a) applying a layer of pressure sensitive adhesive to a first side of a thin plastic strip; and (b) applying an adhesive-repellant coating to the second side of said plastic strip, said adhesive-repellant coating comprising an acrylic polymer primer coat and a silicone-containing top coat.

7. The process for making a reinforcement strip as claimed in claim 6 wherein the primer coat comprises from about 42% to about 48% by wt. of acrylic polymer, from about 18% to about 22% by wt. of ethyl alcohol; from about 3% to about 7% by wt. of isopropyl alcohol; and from about 23% to about 33% by wt. of water.

8. The process according to claim 6 further comprising the additional step of punching holes in said strip at preselected locations.

9. The process according to claim 8 further comprising the additional step of perforating said strip at preselected locations.

10. A reinforcement strip for a loose leaf sheet having a pattern of preselected holes punched therein comprising a plastic strip having a plurality of holes symmetrically arranged such that at least some of said holes coincide with said loose leaf sheet preselected holes, a first side of said plastic strip having a pressure sensitive adhesive applied thereto and a second side of said plastic strip having an adhesive-repellant coating applied thereto, said adhesive-repellant coating comprising an acrylic polymer primer coat and a silicone-containing top coat.

11. A reinforcement strip of claim 10, wherein said plastic strip is perforated at preselected intervals such that said plastic strip may be separated into multiple individual strips, each of said individual strips being of a length equal to or less than the length of said loose leaf sheet.

12. A reinforcement strip for a loose leaf sheet produced by the process of (a) applying a layer of pressure sensitive adhesive to a first side of a plastic strip having a tensile strength of from about 40 to about 100 psi; (b) applying a first the primer coat comprising from about 42% to about 48% by wt. of acrylic polymer, from about 18% to about 22% by wt. of ethyl alcohol; from about 3% to about 7% by wt. of isopropyl alcohol; and from about 23% to about 33% by wt. of water to said second side of said strip and then applying a silicone-containing top coat over said primer coat.

13. A sheet of paper having preselected first holes punched along a first edge of said paper, said paper having a reinforcement strip applied to said first edge, said strip having a pattern of preselected second holes punched therein such that at least some of said second holes in said strip align with said first holes in said paper, said plastic strip having a pressure sensitive adhesive applied to a first side of said plastic strip to maintain said strip in fixed relationship with said paper and said second side of said plastic strip having an adhesive-repellant coating applied thereto, said adhesive-repellant coating comprising an acrylic polymer primer coat and a silicone-containing top coat.

* * * * *